US008187124B2

(12) United States Patent
Ciesar et al.

(10) Patent No.: US 8,187,124 B2
(45) Date of Patent: May 29, 2012

(54) BATTING SWING TRAINER AND METHOD

(75) Inventors: John G. Ciesar, Justice, IL (US); James W. Kendall, Mt. Prospect, IL (US); Scott Massing, Chicago, IL (US)

(73) Assignee: Baseball Marketing Ideas, L.L.C., Justice, IL (US)

( * ) Notice: Subject to any disclaimer, the term of this patent is extended or adjusted under 35 U.S.C. 154(b) by 1084 days.

(21) Appl. No.: 10/407,284

(22) Filed: Apr. 4, 2003

(65) Prior Publication Data

US 2004/0048696 A1 Mar. 11, 2004

Related U.S. Application Data

(63) Continuation-in-part of application No. 09/882,627, filed on Jun. 15, 2001, now Pat. No. 6,949,036.

(60) Provisional application No. 60/370,156, filed on Apr. 5, 2002, provisional application No. 60/246,465, filed on Nov. 7, 2000.

(51) Int. Cl.
*A63B 59/00* (2006.01)

(52) U.S. Cl. ..... 473/457; 473/422; 473/564

(58) Field of Classification Search ..... 473/457, 473/422, 519–521, 549, 552, 558–568
See application file for complete search history.

(56) References Cited

U.S. PATENT DOCUMENTS

| | | | | | |
|---|---|---|---|---|---|
| 5,014,984 | A * | 5/1991 | Brockhoff | 473/457 |
| 5,577,966 | A * | 11/1996 | Duran | 473/234 |
| D445,868 | S * | 7/2001 | Fischer | D21/780 |
| 6,254,498 | B1 * | 7/2001 | Tyner | 473/437 |
| 6,406,387 | B1 * | 6/2002 | Ryan | 473/457 |
| 6,561,930 | B2 * | 5/2003 | Mabry | 473/457 |
| 6,599,200 | B1 * | 7/2003 | Kallassy | 473/204 |

FOREIGN PATENT DOCUMENTS

| | | | |
|---|---|---|---|
| JP | 08024386 | A * | 1/1996 |
| JP | 08024387 | A * | 1/1996 |
| JP | 08033744 | A * | 2/1996 |
| JP | 08266702 | A * | 10/1996 |
| JP | 10043340 | A * | 2/1998 |

* cited by examiner

*Primary Examiner* — Mitra Aryanpour
(74) *Attorney, Agent, or Firm* — Michael Best & Friedrich LLP

(57) ABSTRACT

A baseball batting swing trainer teaches proper bat swinging and ball hitting technique. The swing trainer includes a first handle attached to the first end of a shaft. The second end of the shaft includes a head having a diameter greater than the shaft diameter and less than the diameter of the head of a conventional baseball bat. A cylindrical second handle slidable between the first and second shaft ends. The second handle is sized to accommodate all five fingers on one of the user's hands in a batting grip. A process for teaching a person the proper technique for swinging a baseball bat using the swing trainer is also provided. When performed properly, the process produces an audible sound by striking the second handle against the stop while the head of the bat is passing through the user's strike zone and directly over the user's forward foot.

14 Claims, 5 Drawing Sheets

16
13
15
31
12
28
10
24
26
22
17
14
20
18

30
16
31
32
12
28
24
26
17
22
14
20
18
3
3

4
12
24
4

16
30
28
34
12
24
26
22
14
20
18

4A 30
16
31
12
28
24
26
17
22
14
20
18
4A 16
30
28
12
24
26
22
14
20
18

BATTING SWING TRAINER AND METHOD

This application claims the benefit of U.S. Provisional Application Ser. No. 60/246,465, which was filed on Nov. 7, 2000, and U.S. Provisional Application Ser. No. 60/370,156, which was filed on Apr. 5, 2002, and is a continuation-in-part application of U.S. Traditional application Ser. No. 09/882,627, which was filed on Jun. 15, 2001 now U.S. Pat. No. 6,949,036.

FIELD OF THE INVENTION

The invention relates to a device and system for teaching a person the proper way to swing a baseball bat and hit a baseball or the like. The invention also relates to a swing trainer for teaching a person the proper technique for swinging a bat in order to achieve maximum bat speed and power at impact with a ball. In particular, the swing trainer teaches the user proper body form for swinging a bat and how to use his or her body most effectively when executing a swing and hitting a ball.

BACKGROUND OF THE INVENTION

Teaching a person the proper technique for swinging a bat can be a difficult task. It can require years of practice and training with an experienced batting coach to perfect the batter's swing. Proper swing technique encompasses proper hand placement and body movement, optimal bat acceleration, and ample power to hit the ball and is of the utmost importance in playing such sports as baseball or softball. Of course, proper swing technique ultimately includes making contact with the ball.

Bat trainers and warm-up devices of various kinds have been previously proposed and used. One category of devices helps batters learn to "break" or "bend" their wrists prior to contacting the ball. The theory is that breaking a batter's wrist ahead of the arms prior to contacting the ball will cause the ball to travel a greater distance when contact with the bat is made. Early bat trainers utilized weighted rings that fit around the hitting end of a standard bat. As the batter swings a bat equipped with the weighted ring, the weighted end helps the batter to break his or her wrist, theoretically improving ball distance. U.S. Pat. No. 3,955,816 builds on this concept by altering the location and size of the weights.

Similarly, U.S. Pat. No. 4,555,111 discloses a practice bat that includes a weighted bat head connected to a flexing mid-section. At the beginning of the swing, momentum and the flexing section cause the weighted bat head to lag behind the grip handle. At the end of the swing, momentum and the flexing section cause the weighted end to move ahead of the grip handle. This teaches the batter the proper time to bend or break the hands and wrists during the swing.

Other devices, such as U.S. Pat. No. 3,246,894, describe a practice bat for visibly recognizing where and when the ball contacts the bat. While the previously described trainers may help batters determine when to move their hands and/or wrists during a swing or to recognize the optimal place a bat should contact the ball, none of the bat trainers or warm-up devices described above teaches the batter proper swing technique.

Devices to help improve a batter's swing are available, but these devices typically help the batter to build shoulder and arm muscles used in swinging a bat and improve muscle coordination. Many of these trainers include weights mounted to the shaft of the bat. For example, in U.S. Pat. No. 5,360,209 a batting trainer is disclosed that comprises a handle and a weighted shaft portion attached to a rod extending from the handle. The weighted shaft portion slides away from the grip handle as the batter accelerates the bat during the swing. This device trains the batter to better time acceleration of the bat during the swing by demonstrating the point at which the acceleration of the bat causes the weighted shaft to slide up the rod.

U.S. Pat. No. 4,634,121 discloses a baseball bat swing trainer comprising a baseball bat with a weight that can be mounted at any one of multiple locations on the bat shaft. Changing the position of the weight with respect to the grip handle changes the center of gravity of the bat and alters the effort required by the batter to swing the bat.

Another category of bat swing trainers is illustrated in U.S. Pat. No. 4,399,996, which shows a baseball bat with separate barrel and grip handle portions connected by a spring. The spring is positioned so that the batter's hands will grip the bat on opposite sides of the spring. This arrangement teaches the batter to appreciate and achieve a proper acceleration when the bat impacts the ball.

Swing trainers are also available for use in other sports. For example, a golf swing trainer sold under the name Kallassy Swing Magic™ utilizes a conventional golf club with a shaft, a stationary hand grip and a slideable grip to teach a person how to properly swing a golf club. To practice his golf swing, the user places one hand on the stationary grip and the other hand on the slideable grip, while assuming a conventional golf stance. This posture, with the hands close together and the club perpendicular to the mid-line of the body, constitutes the resting position. At the beginning of the swing, the user swings the club backwards while moving the slideable grip along the club shaft toward the club head and thereby extending his leading arm. When the user's arm is fully extended, the user begins to swing the club forward, past the starting position, while moving the slideable grip toward the stationary grip. As the user completes the follow through of the swing, the user's hands are close together, similar to the resting position. Repeated use of this golf swing trainer teaches a golfer proper swing technique. Because a golf club swing is different from a baseball bat swing, the Kallassy Swing Magic™ device does not offer any benefit when teaching a person proper baseball bat swinging technique.

The majority of the swing trainers described only help the batter to determine optimal bat acceleration or simply increase bat resistance by increasing the weight of the bat. A batter can increase muscle mass by increasing the weight of the bat he or she must swing, but still have poor swing technique. Further, obtaining optimal bat acceleration can be achieved even if the batter's swing technique is poor. Therefore, none of the training bats described above is capable of teaching a batter proper swing technique or the most accurate contact point for a bat to hit a ball.

A need still exists for a new swing training tool that teaches a baseball batter proper swing technique and form. The new trainer should be adaptable to individual batters and allow for differences in body frame, height and strength. The new trainer should teach proper swing technique is taught regardless of the unique characteristics and experience of each batter.

The new trainer should also teach a batter the location of his or her body in relation to the bat during a swing. The new trainer should teach a batter to swing the bat head outwardly and away from the body with the butt of the bat leading. Trainers that simply help a batter to break or bend his or her wrists ignore other parts of the body involved in the proper swing technique of a bat. Further, simply swinging weighted bats does not teach the batter the proper placement of the arms, hands, shoulders and torso throughout a swing of the bat. Outward swinging, while keeping the hands and forearms close to the body with both of the elbows bent, causes the batter to use more of his or her body when executing the swing, thereby achieving more bat speed and power. None of the available swing trainers enable the batter to practice and develop these skills.

The new trainer should demonstrate intuitively to the batter the proper form and position of the body while swinging a bat. When the batter swings the new trainer, he or she should readily feel where the optimal placement of the hands, arms and body is during and after the swing. Repeated use of the new swing trainer should promote muscle memory for proper swing technique, thus allowing the batter to draw on those memories to utilize proper technique when swinging an actual, non-training bat.

Desirably, the new swing trainer should also permit the user to check the results of his or her training. The new trainer should be a self-teaching training tool that a batter can use alone without the need for an experienced training coach.

Also, baseball enthusiasts would welcome a new trainer that permits the user to determine the most accurate contact point when hitting a ball with a bat. The new trainer should enable the user to audibly determine such contact point or "sweet spot" when the bat head strikes a ball. The distinct sound and feel of contact will train the user to hit with force, strength and accuracy when using a regulation bat and ball.

SUMMARY OF THE INVENTION

The invention is a swing trainer for use in batting sports to instruct a batter on proper swing technique and ball-hitting form. The swing trainer is constructed of aircraft grade aluminum or other suitable material and comprises an elongated shaft having a circular cross-section with a first or grip handle on one end of the shaft and a ball-hitting head on the other end. The head is smaller in diameter than a comparable baseball bat, in order to force the batter to concentrate. A "sweet spot" for hitting the ball is conspicuously marked on the head.

The shaft is preferably solid and has a substantially uniform circumference throughout most of its length. The grip handle resembles that of a conventional baseball bat handle. A leather wrap, foam grip or other suitable material covers the handle to give the user a comfortable non-slip surface to hold. Although the swing trainer does not look exactly like a conventional baseball bat, it is constructed to provide a weight and balance similar to that of a conventional baseball bat.

A graspable, generally cylindrical second handle or slide is mounted on the shaft for sliding movement along the shaft between the head and a stop, which is located on the shaft near or adjacent the handle. The curved, outer surface of the slide is covered with a leather wrap, foam grip or other suitable material to match the covering on the first handle. The stop can be a one-piece circular member that slides onto the shaft before the handle is attached, or two separate semi-circular portions that are fastened together around the shaft. The stop is made of aluminum or other suitable material. The stop must be mounted on the handle so that it will not move or come off during use.

Two buffers are made of plastic, aluminum, nylon, polyethylene, or other suitable material that produces an attention-getting noise when the buffer strikes the stop or the head. A lower buffer is attached to the end of the slide closest to the handle to signal that the slide has reached the handle, to prevent pinching of the batter's hand and to provide additional protection against the slide inadvertently leaving the shaft. An upper buffer is preferably attached to the slide to signal that the slide has reached the head and to prevent a batter's hands from being pinched between the slide and the bat head. Preferably, the head includes a stop for rapidly decelerating the slide and, simultaneously, making an unmistakable sound upon contact with the upper buffer.

The bat head is elongated and serves as a means to prevent the slide from separating from the shaft. The head is generally weighted and can be so constructed as to accommodate different sized weights for interchanging on a single trainer or to accommodate longer shafts. Preferably, the head is properly weighted to give the swing trainer the total weight and balance of a comparable length baseball bat.

The head is connected to the shaft using an epoxy glue, pin and/or other suitable means. For example, a standard shear, spring or roll method of pinning can be utilized to attach the head, as well as the handle, to the shaft. In an alternative embodiment, the head can be removable and interchangeable with other sized and weighted heads.

The head is preferably composed of solid aircraft grade aluminum and is about 7 to 7½ inches long. This permits the bat to be used to hit hard balls, soft balls, tenis balls or whiffle balls at a place along the bat head, which is equivalent to the "sweet spot" of an ordinary baseball bat. In general, the sweet spot of a baseball bat is about 4½ to 5½ inches from the tip end of the bat so the head is long enough to accommodate this feature. The sweet spot of the swing trainer is conspicuously marked with, for example, a plurality of parallel longitudinal grooves. These grooves reflect light and show up well in training movies, which permit the batter to subsequently observe the precise relationship of the ball to the sweet spot during his swing.

The shaft may vary in length and, preferably, includes a solid rod of aircraft grade aluminum adapted to withstand the forces generated when the head strikes a conventional hard ball of the type used in major league baseball baseball thrown overhead toward the batter. Of course, the solid aluminum shaft can also be used to hit soft balls, tennis balls and whiffle balls, which all generated relatively less severe forces as compared to the hard ball. If the user does not intend to hit hradballs thrown overhand, a hollow shaft or a polymer shaft is entirely sufficient.

One of the embodiments of the invention is known as "the one-handed trainer" because it is especially adapted for performing batting drills with only one hand on the bat. It is substantially similar to the embodiments described above, except that the shaft is composed entirely of nylon or some other strong and lightweight polymer. Because the one-handed trainer is relatively light in weight, typically weighing about 19 ounces, it enhances the user's natural agility and permits one-handed batting drills to be performed for longer periods without producing undue fatigue in the user. The one-handed trainer also enables smaller batters, such as children, for example, to use the trainer effectively.

To use the trainer to teach swing technique and form, the user places one hand on the handle of the swing trainer. This hand is held lower than the other hand throughout the swing. For a right-handed batter, this will be the left hand. The other hand of the user is placed on the slide, which is moved to the top of the shaft in contact with the head. This constitutes the resting or initial position. Both elbows are bent in the initial position. At the start of the swing, the swing trainer is at about shoulder height and the batter's hands are spaced apart on the respective grips almost the entire length of the shaft. As the swing progresses, the slide is moved down the shaft toward the handle until the lower buffer contacts the stop just above the handle with a noticeable "clack." At this point the two handles and, consequently, the user's hands will be close together. Ideally, the position is reached and rewarded with this audio feedback just as the bat passes over the batter's forward foot with the sweet spot in the strike zone. This movement of the hands during the swing causes the batter to swing the bat head outwardly away from the body while keeping the hands and forearms close to the body. The sound produced by the lower buffer on the stop is both a timing signal and a reward to the batter. Through repetitious use of the swing trainer, batters will develop muscle memory allowing them to swing a conventional bat more effectively.

Further, the batter may practice hitting a hollow ball to determine the most accurate contact point for the bat to connect with a ball. Such contact point will cause the ball to accurately travel the greatest distance. The contact point is determined by a distinct audible sound emitting from the bat heat when the hollow ball strikes the contact point. Repeated use of the trainer with a hollow ball allows the batter to determine the location of contact between bat and ball that translates when using regulation equipment. Thus, the batter becomes skilled at hitting a ball accurately and far.

As training progresses using the inventive trainer, the user may test his or her progress by placing the slide in its position closest to the handle and gripping the trainer in a manner similar to a conventional bat, i.e., with both hands on the first handle and the elbows bent. Then, the batter swings the trainer as if it were a conventional bat. During the swing, the slide will move along the shaft from the first handle area and strike the head. The sound emitted from this exercise increases as bat speed and power increases, thereby audibly informing the user of the results of his or her training efforts. In this way, the new trainer can be used to check whether the user has achieved an increase in bat speed and power.

Ideally, the sound is heard at the same point in the swing as during the above-described split-grip exercise. More specifically, the upper buffer sounds just as the swing trainer passes over the batter's forward foot, with the sweet spot in the strike zone. Because the audio feedback and reward sounds of the two exercises are similar, the sounds link the two exercises in the batter's mind so that one exercise reinforces the other. The two-handed exercise challenges the batter to use the proper techniques he learned in the split-grip exercise.

Further, the batter may use the inventive trainer to practice hitting a baseball to achieve a consistent pattern of hitting the "sweet spot" of the bat. The baseball can be a "hardball," just as the major league baseball players use. The "soft-toss exercise" is accomplished by the batter using a two-handed grip on the handle, while aiming at a baseball thrown underhand from about six feet away and off to the side of the batter. The "short-toss exercise" is substantially the same, except that the baseball is thrown from straight in front of the batter at a distance of about 15 to about 20 feet. In the "overhand-toss exercise," the baseball is thrown overhand and straight on from a distance of about 20 feet. Of course, these hitting exercises must be performed with adequate protection for the thrower.

In each of the hitting exercises, the slide is held against the handle by gravity alone in the initial position and flies toward the head under the influence of centripetal acceleration during the swing. A high degree of concentration is required to hit the baseball with the swing trainer because the head of the swing trainer is narrower than that of a conventional baseball bat. With each swing, the batter can conform the timing of his swing and the point of least acceleration. Hitting the baseball with the sweet spot while the upper buffer is sounding and the head is in the strike zone directly over the front foot is an elusive goal that is immediately rewarded by the swing trainer. Hitting this contact point on a conventional bat will cause the ball to travel the greatest distance.

An inexperienced batter can use the new trainer to learn how to swing a bat properly and with the correct technique. Similarly, an experienced batter can use the new trainer to improve his or her current swing technique or to increase the power behind an already perfected swing. Further, the new trainer can be used in many sports requiring the use of a bat or the like, including but not limited to baseball, softball, cricket and the like.

DETAILED DESCRIPTION OF THE PREFERRED EMBODIMENTS

Figure 1:
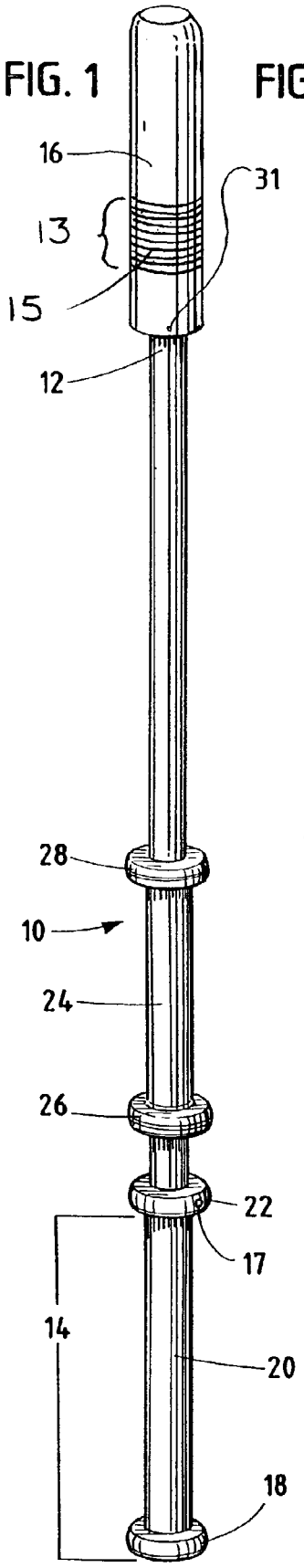
FIG. 1 is a perspective view of one embodiment of this invention.
Figure 2:
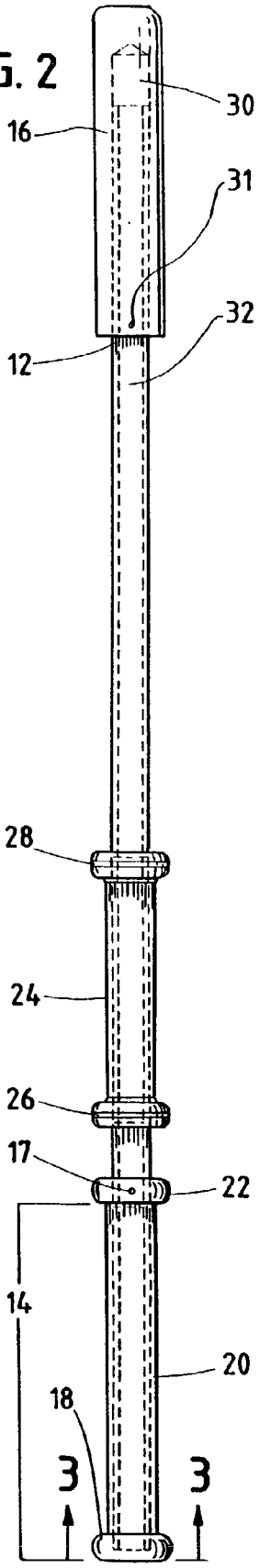
FIG. 2 is a front elevation view of the embodiment of FIG. 1 with phantom lines depicting a hollow shaft.
Figure 3:
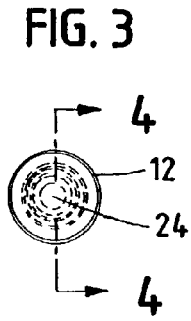
FIG. 3 is a bottom view taken along lines 3-3 of FIG. 2.
Figure 4:
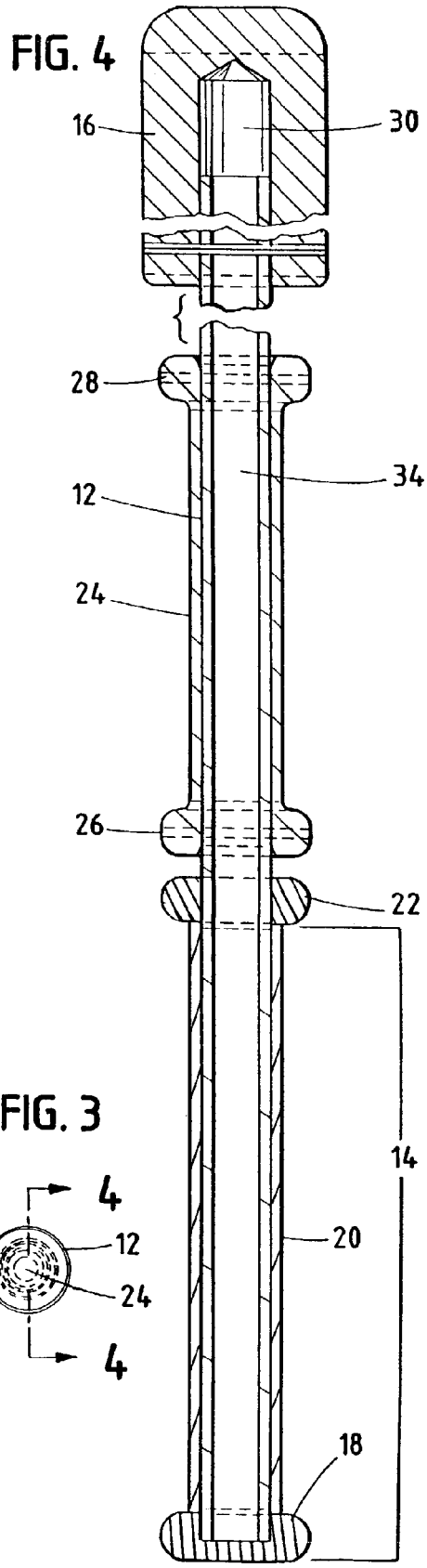
FIG. 4 is a cross-sectional view taken along lines 4-4 of FIG. 3 with portions broken away.

Referring to FIGS. 1-4, one embodiment of the swing trainer 10 is shown. Specifically, FIG. 1 shows a swing trainer 10 comprising a shaft 12, with a first or grip handle 14 on one end and a head 16 on the other. The sweet spot 13 of swing trainer 10 is conspicuously marked with, a plurality of parallel longitudinal grooves 14. The handle 14 resembles the handle of a conventional baseball bat, having an end cap 18 and a gripping portion 20, which may be covered with a leather or fabric wrap, foam grip, or other suitable material. Preferably, handle 14 is sized to accommodate both of the user's hands in a batting grip. A stop 22 is attached to the shaft 12 by a standard roll, shear or spring pin 17 or other suitable means, adjacent to the handle 14. The shaft 12, end cap 18, and stop 22 can be made of aircraft grade aluminum or other suitable material. Shaft 12 may be hollow, as depicted in FIG. 2. Alternatively, shaft 12 may be solid throughout substantially its whole length, except for a portion adjacent handle 14, as depicted in FIG. 2A.

A graspable second handle or slide 24 is mounted to the shaft 12 and moves along the shaft 12 between the stop 22 and the head 16. The slide 24 is sized to accommodate all five fingers on one of the user's hands in a batting grip. The slide 24 may contain first and second buffers 26, 28 on each end and, similar to handle 14, is covered with a leather or fabric wrap, foam grip or other suitable material to accommodate at least one hand. Preferably, the slide 24 and handle 14 are each generally cylindrical and have about the same diameter. Preferably, the covering for each is substantially the same. The buffers 26, 28 can be made of plastic, such as aluminum, nylon, or other suitable material that is capable of withstanding repetitive impacts and generates a sound easily heard by the batter and bystanders when one of the buffers 26, 28 strikes stop 22 or head 16. The head 16 is weighted and serves as an upper stop for the slide 24. As shown in FIG. 2, the head 16 contains a bore 30 that receives the shaft 12. The head 16 and shaft 12 are permanently connected together using a standard roll, shear or spring pin 31. Alternatively, the head 16 and shaft 12 can be bonded together using an epoxy glue or other suitable attaching means.

Figure 2A:
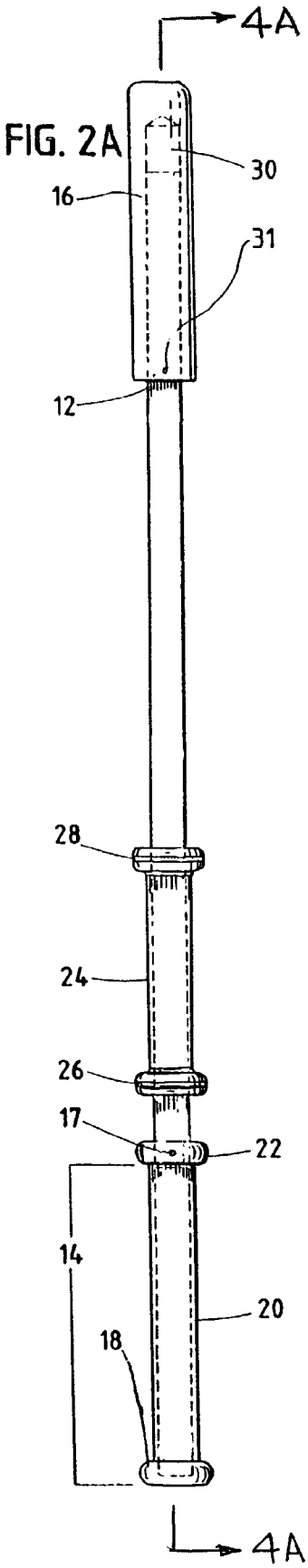
FIG. 2A is a front elevation view of the embodiment of FIG. 1 with phantom lines depicting a solid shaft.
Figure 4A:
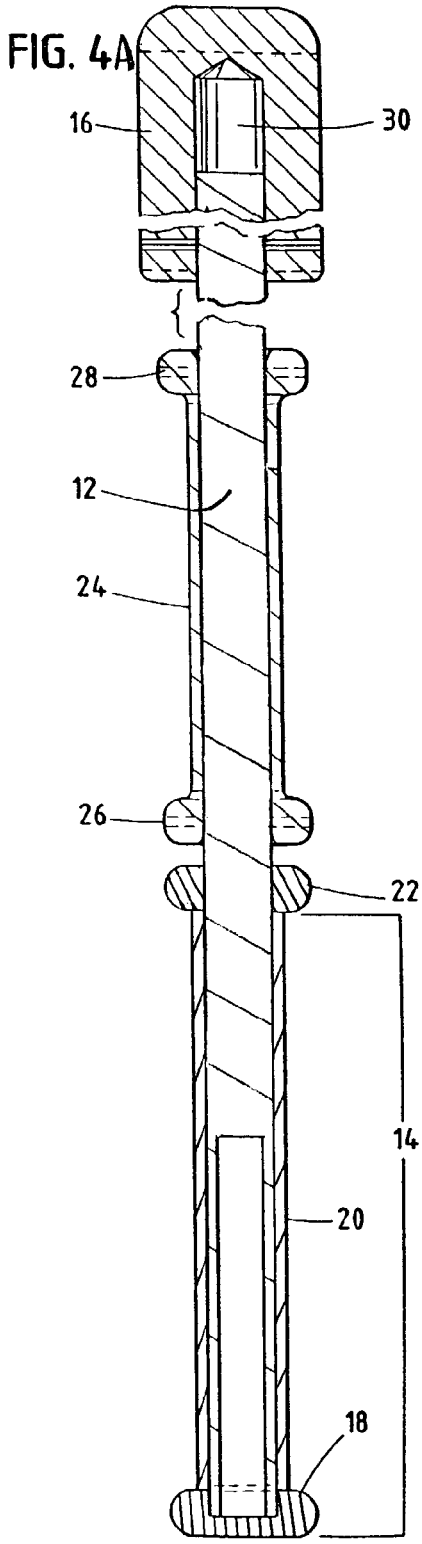
FIG. 4A is a cross-sectional view taken along lines 4A-4A of FIG. 2A with portions broken away.

Referring to FIG. 2A, the shaft 12 is generally solid along all or most if its length to better withstand the forces generated when head 16 strikes a conventional baseball A minor portion of shaft 12 may be hollow, however, to provide, for example, weight balance along the trainer 10 comparable to that of a conventional baseball bat. By adjusting the length and diameter of head 16 and providing a minor hollow portion in the shaft adjacent handle 14 a swing trainer, such a swing trainer 10, can be made to exhibit essentially the same heft and balance as a baseball bat having the same weight and overall length. If a hollow portion is incorporated in shaft 12, the hollow portion is preferably located adjacent handle 14 where forces arising from head 16 striking a conventional baseball are relatively less severe.

Figure 8:
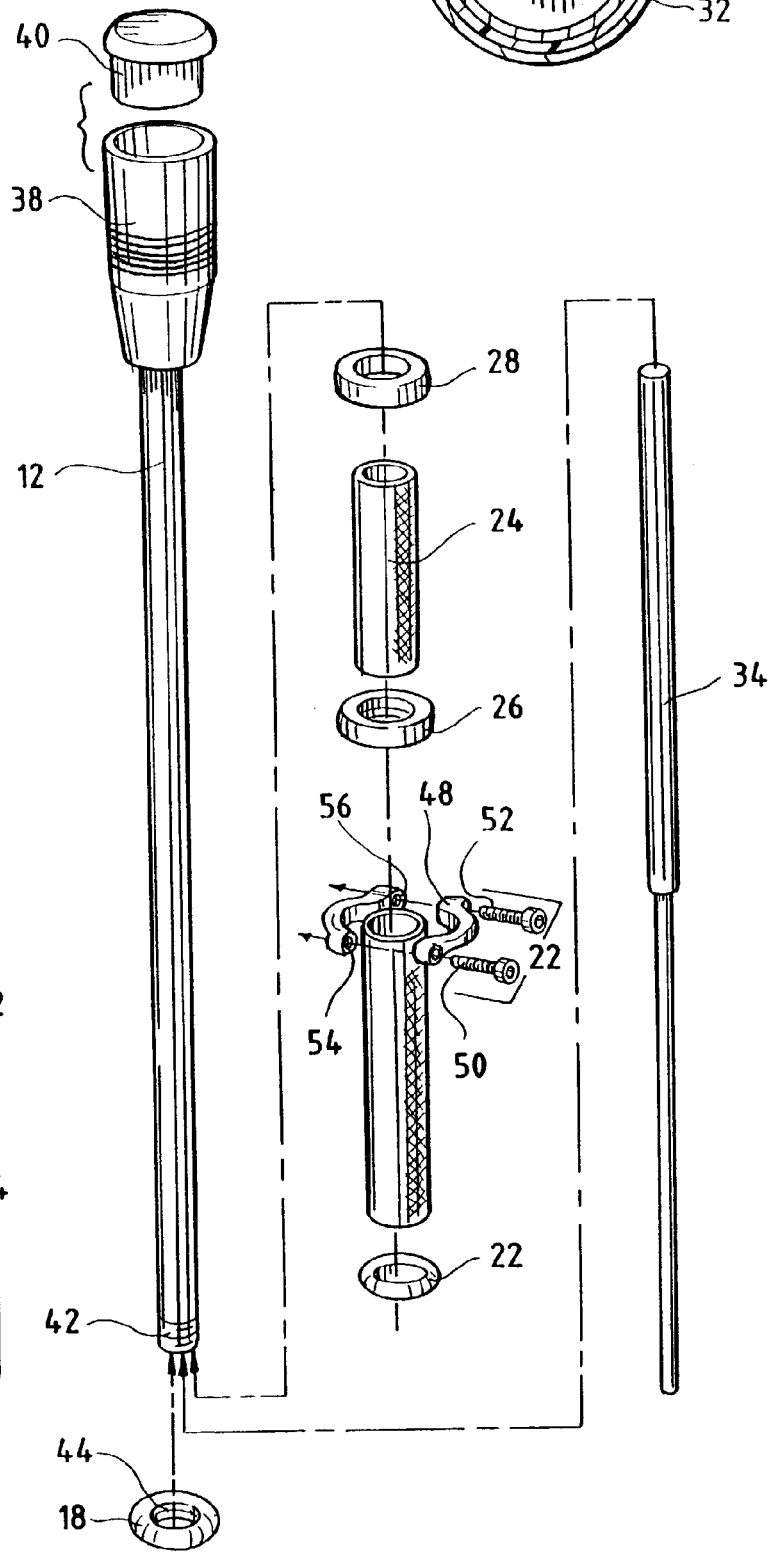
FIG. 8 is an exploded perspective view of the embodiment of FIG. 7.

The trainer 10 is constructed by securing the first and second buffers 26, 28 to the ends of the slide 24 and then mounting the slide 24 onto the shaft 12. Then, stop 22 is slid onto the shaft 12, followed by the attachment of the handle 14 to one end of the shaft 12. As illustrated in FIG. 2 and FIG. 8, the weighted rod 34 is inserted into the core 32 of the shaft 12 and the shaft 12 is then secured by welding, epoxy glue, a pin 31, or other securing means to the head 16. The end cap 18 is then attached to the handle end of shaft 12, by welding, epoxy glue, a pin, or other suitable means.

Figure 7:
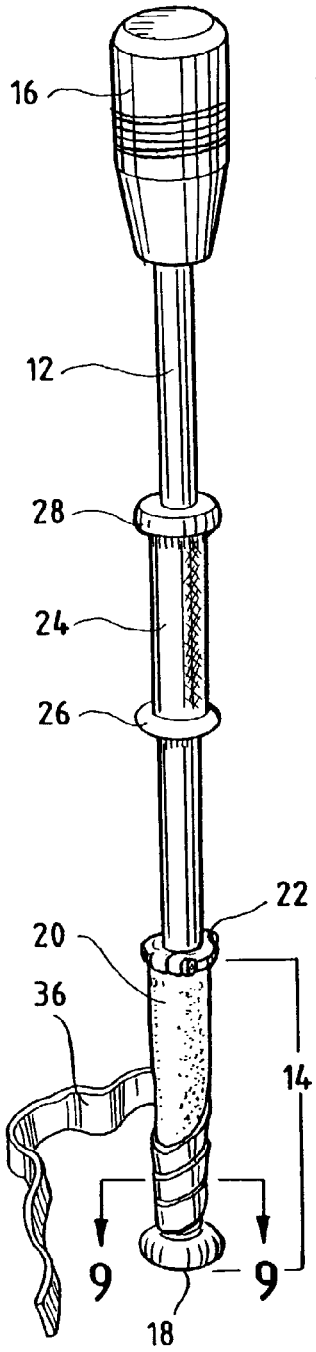
FIG. 7 is a perspective view of another embodiment of this invention.
Figure 9:
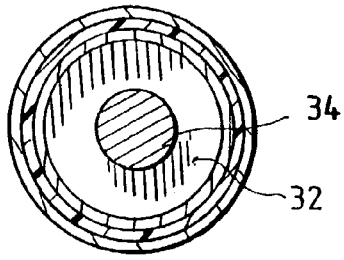
FIG. 9 is a cross-sectional view taken along lines 9-9 of FIG. 7.

Referring to FIGS. 7-9, another embodiment of the trainer 10 is shown. In this embodiment the trainer 10 comprises a shaft 12, with a handle 14 on one end and a head 16 on the other. The handle 14 contains an end cap 18 and a gripping portion 20, which similar to the embodiment of FIGS. 1-4, may be covered with a leather or fabric wrap 36, foam rubber, or other suitable material. A stop 22 is attached to the shaft 12 adjacent to the handle 14. Like the slide of the first embodiment, this slide 24 is mounted on the shaft 12 and moves along the shaft 12 between the stop 22 and the head 16. The slide 24 contains first and second buffers 26, 28 on each end, and can accommodate at least one hand. The head 16 comprises a receptacle 38 and a cap 40 and serves as an upper stop for the slide 24. As shown in FIGS. 8 and 9, the handle-end of the shaft 12 includes a threaded portion 42 to which the end cap 18 may be attached by means of complementary threads 44 in the end cap 18.

Assembly of this embodiment is similar to the first embodiment, with a few exceptions (see FIG. 8). The first and second buffers 26, 28 are affixed to the ends of the slide 24, which is then mounted onto the shaft 12. Then, the handle 14 is attached to the shaft 12 and the end cap 18 is attached to the end of shaft 12. With the handle 14 in place, the stop 22 is secured to the shaft 12, as shown in FIG. 8. The stop 22 has first and second halves 46 and 48 that surround the shaft 12. The halves 46 and 48 are secured to each other with screws 50, 52 or other means that securely hold the stop 22 on the shaft 12. As shown in FIG. 8, screws 50, 52 are received in threaded portions 54, 56. The cap 40 is then inserted into the receptacle 38 of the head 16 and secured in a way which will not allow it to come off during use of the swing trainer 10.

If desired, the batting trainer of this invention may be made with varying sized handles and grips to accommodate people with varying hand sizes. Various lengths for shafts 12 may also be used, and interchangeable heads 16 and the cap 40 may be made with varying weights, diameters and lengths to alter the difficulty level of the swing trainer 10.

Figure 5A:
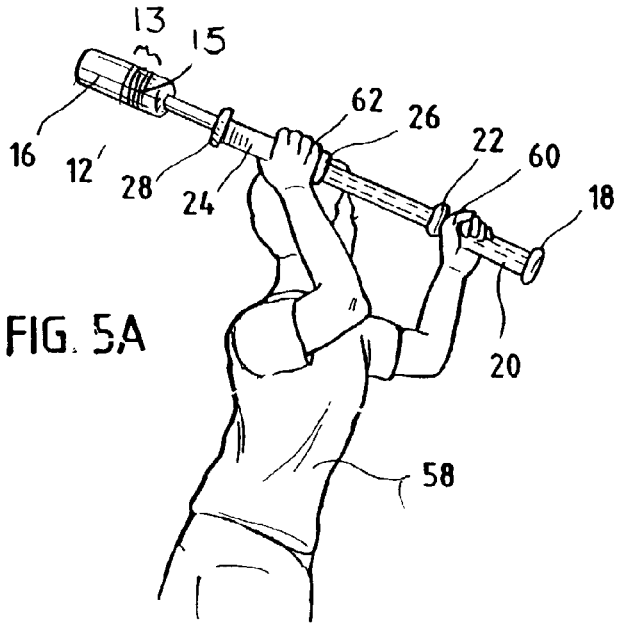
FIGS. 5A, 5B, 5C show a batter swinging the embodiment of FIG. 1 with one hand on the handle and the other hand on the sliding grip, progressing from the starting position (5A), to the mid-point of the swing (5B), and to the completion of the swing (5C)
Figure 5B:
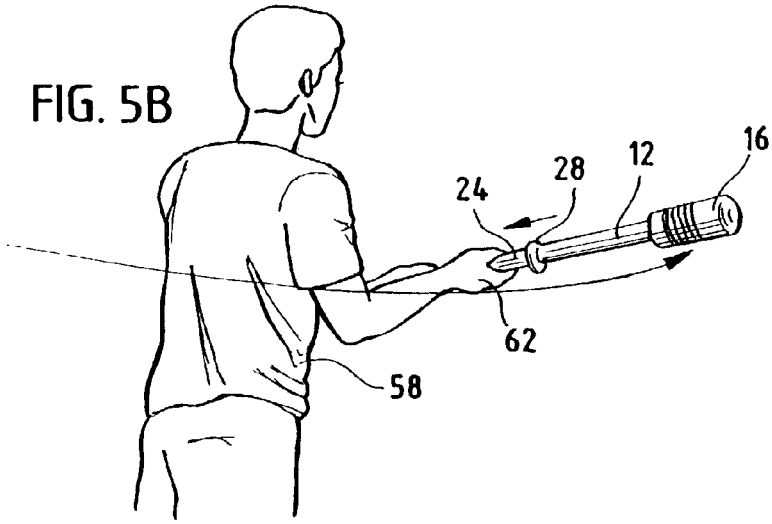
Figure 5C:
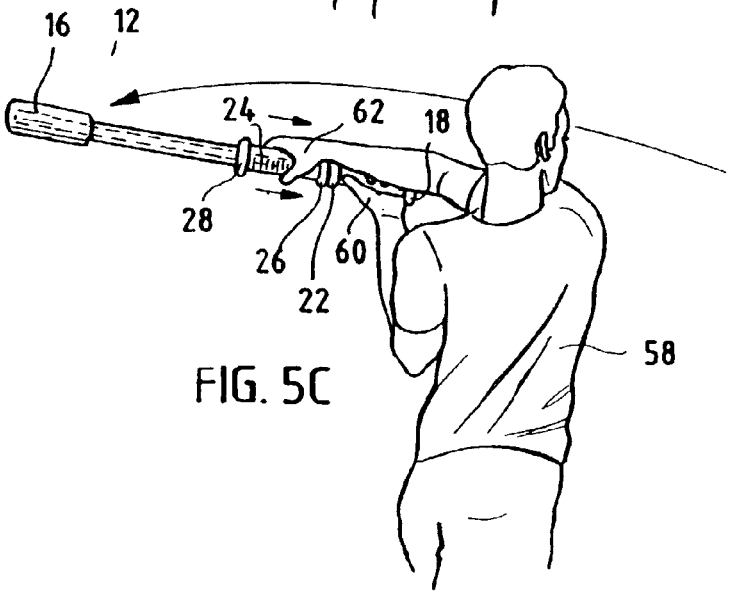

In FIG. 5A, grooves 15 conspicuously mark the location of sweet spot 13. Referring to FIGS. 5A, 5B, and 5C, the typical use of the swing trainer in a "split-grip" exercise is shown. A person 58 grips the trainer 10 with one hand 60 on the first handle 14 and the second hand 62 on the second handle or slide 24. The hand on the handle 14 preferably is located adjacent the stop 22, thus causing the user to have a "choked-up" position on the handle 14 with both elbows bent. As the user looks in the direction of the ball (real or imaginary), the head 16 of the swing trainer 10 is held raised at about the height of the user's head and is positioned substantially over the person's 58 rear shoulder (see FIG. 5A). In the initial or starting position (FIG. 5A), the user moves the slide 24 toward the head 16 until the user reaches a comfortable arm extension or the second buffer 28 comes to rest at the base of the head 16. Thus in the starting position, the user's hands are spaced apart, the spacing varying depending on the user's size and reach.

As the user begins to swing the trainer 10, the slide 24 is moved along the shaft 12 toward the handle 14, as shown in FIG. 5B. This causes the user to swing the bat head 16 outwardly, away from the person's body, and above the person's knees and equal to or lower in elevation than the person's shoulders (see FIG. 5B), while keeping the hands and forearms close to the body. As the user completes the swing (FIG. 5C), the slide 24 is moved further along the shaft 12 until the slide 24 is stopped by the stop 22. Thus, at the completion of the swing, the user's hands 60, 62 are in close proximity, much like on a conventional baseball bat. At this point, the first buffer 26 contacts the stop 22 (FIG. 5C) and, preferably, generates a sound sufficiently loud to be heard by the user and bystanders. Using the swing trainer 10 in this way trains the user to swing a conventional bat head outwardly away from the body, while keeping the hands and forearms close to the body, thereby causing the user to use more of his or her body when executing a swing. The sound made by buffer 26 upon striking stop 22 is both a timing signal and a reward for the user. Ideally, the user hears this sound just as head 16 passes over the user's forward foot at a height and extension that places head 16 in the strike zone. With repetitive practice swings using the trainer 10, proper form and technique should eventually become sufficiently developed so that the person understands how it feels to swing with correct form and duplicates such form and technique when swinging a conventional baseball bat. As the user becomes increasingly proficient using the swing trainer 10, the user can increase the resistance of the trainer 10 by increasing the weight of the head 16 (as shown only in the second embodiment). As a user's skill and physical requirements change, the size of the handle 14, the length of the shaft 12 or the weight of the bat head 16 can be altered to accommodate the changes.

Figure 6A:
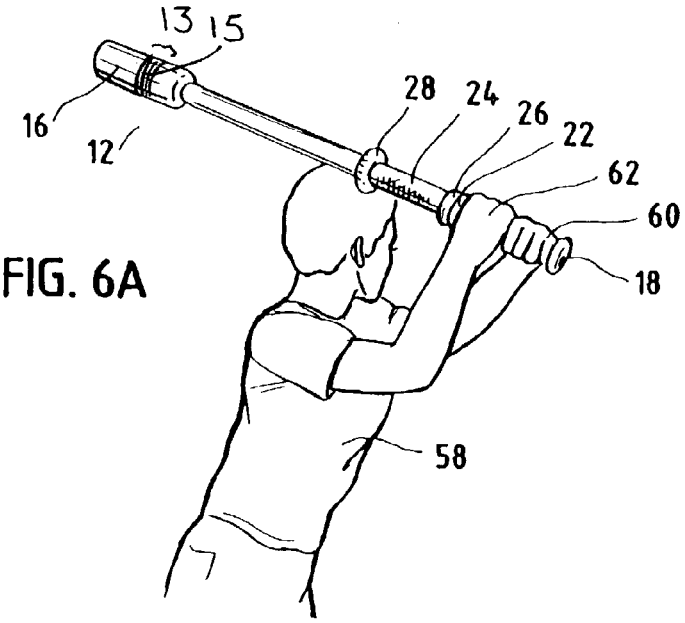
FIGS. 6A, 6B, 6C show a batter swinging the embodiment of FIG. 1 with both hands on the handle, progressing from the starting position (6A), to the mid-point of the swing (6B) where the sliding grip contacts the head, and to the completion of the swing (6C)
Figure 6B:
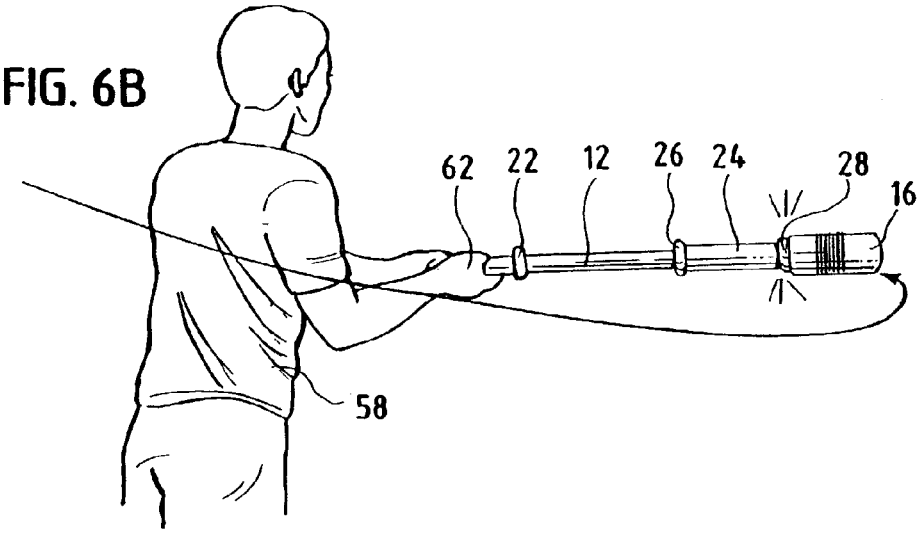
Figure 6C:
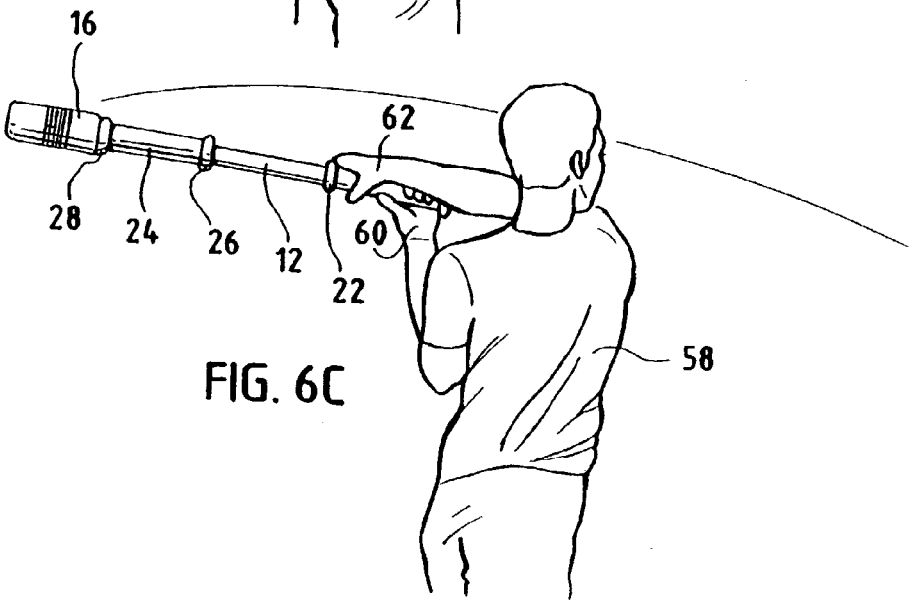

Referring to FIGS. 6A, 6B and 6C, use of the swing trainer is shown in a "two-handed grip" exercise. The two-handed grip exercise can be performed with a ball, with a training ball (such as a rubber ball or a whiffle ball) or with a conventional baseball (commonly known as a hardball). The purpose of the two handed grip exercise is to check the results of the user's training efforts with the inventive trainer. A person 58 grips the swing trainer 10 by placing both hands on the handle 14, as shown in FIG. 6A. In the initial or starting position (FIG. 6A), the user's hands are close together on the handle 14, and the elbows are bent, and the head 14 is positioned substantially over the person's 58 rear shoulder, as with a conventional bat, and the slide 24 is located adjacent the handle and allowed to slide freely along the shaft 12. The user looks toward the ball, and holds the head 16 at about the height of the user's shoulder.

As the user begins to swing the trainer 10 above the user's knees and equal to or lower in elevation than the user's shoulders, the slide 24 moves along the shaft 12 toward the head 16, as shown in FIG. 6B, eventually contacting the head 16 and emitting an audible sound to indicate the force that the user generated by his or her swing. The louder the sound, the greater the swing force. Preferably, the user bears this sound just as the head 16 passes over the user's forward foot. Most preferably, the user hears this sound just as the head 16 strikes the ball. As the user completes the swing (FIG. 6C), the slide 24 will remain adjacent the head 16.

Using the trainer 10 in this way, i.e., the check mode, allows the user to determine whether he or she has achieved greater power in the swing of the bat as a result of the use of trainer 10 in the split-hand grip exercise (described in FIGS. 5A-5C). As shown in FIGS. 6A-6C, the audible sound would be caused by the impact of the slide 24 against the head 16, but other mechanical or electronic means can be used to emit sounds, such as a bell or the like.

The trainer can also be used in the manner shown in FIGS. 6A through 6C to practice hitting a conventional hardball baseball, a softball baseball, a hollow whiffle ball, a tennis ball or a soft practice baseball, among others, with the trainer. Sweet spot 13 of swing trainer 10 is conspicuously marked with, for example, a plurality of parallel longitudinal grooves 15, as depicted in FIG. 6A. The head of the trainer is dimensioned both in circumference and length to assist hand-eye coordination by use of the bat head's circumference and length to provide enough surface area for the batter to hit the training ball. By constructing the end of the trainer to be about 7 to 7½ inches in length, it will be of sufficient size to allow hitting the practice ball in an area of the trainer equivalent to the sweet spot of a conventional baseball bat. The sweet spot is usually located about 4½ to 5½ inches from the top of the conventional bat. As shown in FIG. 1, for example, sweet spot 13 is demarcated on trainer 10 by parallel circumferential grooves 15, which the user can employ to visually determine during practice whether he or she is achieving point of contact with the ball at sweet spot 13.

The preceding embodiments are to be regarded as illustrative of the invention, and it will be apparent to those skilled in the art that modifications may be made without departing from the objects of the invention. These modifications are intended to be included within the scope of the invention, as set forth in the appended claims and it is not intended that the invention be otherwise limited.

What is claimed is:

1. A process for teaching a person the proper technique for swinging a baseball bat to improve the person's ability to contact a ball moving through a strikezone, the process comprising:

using a batting swing trainer including a shaft having a first end and a second end and a constant diameter between the first and second ends, the first end including a first handle sized to accommodate both of the person's hands, the second end including a head for contacting a ball and being connected to the shaft such that the head is not movable relative to the shaft, the head being concentric with the shaft and having a diameter greater than the shaft and less than the head of a comparable baseball bat, a stop positioned on the shaft adjacent to the first handle, and a second handle movable between a first position and a second position and sized to accommodate all fingers on one of the person's hands in a batting grip;

positioning the batting swing trainer in a first swing position, in which the first handle is gripped by one hand, the second handle is gripped by all fingers of the other hand, both elbows are bent and the second handle is positioned substantially over a rear shoulder of the person; and swinging the trainer from the first swing position to a second swing position, wherein in the second swing position the batting swing trainer is positioned above the person's knees and equal to or lower in elevation than the person's shoulders, while simultaneously moving the second handle from the first position where it is adjacent to the second end to the second position where the second handle is adjacent the stop.

2. The process of claim 1, wherein the person grips the first handle adjacent to the stop.

3. The process of claim 1, wherein the person swings the second end outwardly and away from the person's body.

4. The process of claim 1, wherein the person also performs the further steps of placing the second handle adjacent the stop, gripping the first handle with both hands similar to holding a conventional baseball bat, and swinging the bat in the same manner as a conventional bat, causing the second handle to move along the shaft until it strikes the second end and produces an audible sound, whereby the person can determine the force of the swing.

5. The process of claim 4, wherein during the swinging the trainer strikes a hard ball and causes it to fly about ten yards or more.

6. The process of claim 5, wherein the second end includes a sweet spot that is conspicuously marked and a photographic record is made of the trainer striking the hard ball and the user inspects the photographic record to determine where the hard ball touched the trainer with respect to the sweet spot.

7. The process of claim 1 in which the second handle in the second position is sufficiently spaced from the first handle to prevent the person's hands from overlapping.

8. The process of claim 1 further comprising producing an audible sound by striking the second handle against the stop.

9. The process of claim 8, wherein the second end includes a sweet spot and the audible sound is produced as the swing trainer passes over the person's forward foot with the sweet spot equal to or higher in elevation than the person's knees and equal to or lower in elevation than the person's shoulders.

10. The process of claim 8, wherein the person also performs the further steps of placing the second handle adjacent the stop, gripping the first handle with both hands similar to holding a conventional baseball bat, and swinging the bat in the same manner as a conventional bat, causing the second handle to move along the shaft until it strikes the second end and produces an audible sound, whereby the person can determine the force of the swing.

11. The process of claim 10 in which the audible sound of the second handle striking the stop is produced at substantially the same point of the swing as the sound of the second handle striking the second end.

12. A process for teaching a person the proper technique for swinging a baseball bat to improve the person's ability of contacting a ball moving through a strikezone, the process comprising:

using a batting swing trainer including a shaft having a first end and a second end, the first end including a first handle sized to accommodate both of the person's hands, the second end including a head for contacting a ball and having a diameter greater the shaft, a stop positioned on the shaft adjacent to the first handle, and a second handle positioned on the shaft between the first handle and the head and movable between a first position and a second position, the second handle being sized to accommodate all fingers of one of the person's hands in a batting grip;

gripping the trainer in a first configuration, in which the first handle is gripped by one hand, the second handle is gripped by all fingers of the other hand, both elbows are bent, and the second handle is positioned substantially over the person's rear shoulder;

swinging the trainer after gripping the trainer in the first configuration while simultaneously moving the second handle from the first position, in which the second handle is adjacent to the head, to the second position, in which the second handle is adjacent the stop;

gripping the trainer in a second configuration, in which the first handle is gripped by both hands, both elbows are bent, and the second handle is adjacent the stop; and swinging the trainer after gripping the trainer in the second configuration in a manner similar to a conventional baseball swing, thereby causing the second handle to move along the shaft toward and into contact with the head.

13. The process of claim 12, further comprising:

producing an audible sound by striking the second handle against the stop; and producing an audible sound by striking the second handle against the head.

14. The process of claim 13, wherein the audible sound of the second handle striking the stop and the audible sound of the second handle striking the head are produced at similar points during swinging of the trainer.

* * * * *